United States Patent [19]

Meyer

[11] Patent Number: 4,765,538

[45] Date of Patent: Aug. 23, 1988

[54] ELASTIC RAIL BEARING

[75] Inventor: Gerd Meyer, Hamburg, Fed. Rep. of Germany

[73] Assignee: Phoenix Aktiengesellschaft, Hamburg-Harburg, Fed. Rep. of Germany

[21] Appl. No.: 849,547

[22] Filed: Apr. 8, 1986

[30] Foreign Application Priority Data

Apr. 11, 1985 [DE] Fed. Rep. of Germany ..... 3512987

[51] Int. Cl.[4] ..... E01B 9/62; E01B 19/00

[52] U.S. Cl. ..... 238/283; 238/382

[58] Field of Search ..... 238/6, 7, 283, 264, 238/310, 297, 382, 349

[56] References Cited

U.S. PATENT DOCUMENTS

| | | | |
|---|---|---|---|
| 4,266,719 | 5/1981 | Ortwein et al. | 238/382 X |
| 4,494,695 | 1/1985 | Sonneville | 238/297 X |
| 4,629,118 | 12/1986 | Langman | 238/264 X |
| 4,648,554 | 3/1987 | McQueen | 238/283 |

FOREIGN PATENT DOCUMENTS

| | | | |
|---|---|---|---|
| 1240544 | 5/1967 | Fed. Rep. of Germany . | |
| 2850039 | 5/1979 | Fed. Rep. of Germany . | |
| 3341681 | 5/1985 | Fed. Rep. of Germany . | |
| 0153407 | 12/1979 | Japan | 238/283 |
| 83694 | 4/1935 | Sweden | 238/283 |

*Primary Examiner*—Johnny D. Cherry

*Attorney, Agent, or Firm*—Collard, Roe & Galgano

[57] ABSTRACT

An elastic rail bearing for railroad rails includes a top plate, a bottom plate, and a rubber plate disposed inbetween the top and bottom plates, the plates each having a plurality of holes formed therethrough with the holes of one plate being in registered alignment with the holes of the other plates. One or more bolts are provided, each of which is surrounded by a rubber ring with each of the bolts passing through one of the aligned set of holes in the top, bottom and rubber plates and engaging a nut such that an adjustable and variable initial stress may be established in the rail. At least one of the rubber plates, and the top and bottom plates, have a protrusion and the other has a corresponding recess for receiving the protrusion. The top and bottom plates each have a vertical flange which are spaced apart from, extend parallel to, and partially overlap each other. A connecting rubber strip is disposed inbetween the flanges.

13 Claims, 3 Drawing Sheets

ELASTIC RAIL BEARING

BACKGROUND OF THE INVENTION

The invention relates to an elastic bearing for rails. More particularly, it relates to an elastic rail bearing for railroad type rails, capable of being variably adjusted to a specified counteracting prestress and resonant frequency.

Different designs for elastic bearings for railroad rails are known in the art. These elastic rail bearings serve to reduce the noise generated by railroad vehicles and also to reduce the level of noise transmitted into the ground. Furthermore, such elastic bearings protect the rail bed substrate, as well as the wheel sets of the railroad vehicles. This is especially important for bridges and tunnels and other man-made railroad substrates. Also, such an elastic bearing can be successfully used for reducing railroad noise in residential areas.

A particularly advantageous design is described in German Patent DE OS No. 33 41 681. A bearing of this known type, owing to the fact that it is capable of variable prestress adjustment, can be adjusted to different resonant frequencies. This adjustment permits a reduction of the noise and sound conducted through solids within the frequency ranges that are particularly troublesome. However, this known bearing is basically limited to defined wheel set loads and defined speed ranges. This means that different bearing designs are required for different railborne vehicles such as streetcars and railway vehicles. Also this known rail bearing has a space requirement which may be relatively high, and it may have a design height that poses problems in special cases.

Accordingly, it is an object of the invention to provide an elastic rail bearing having a compact structure, and which may be easily adjusted to different requirements.

It is also an object of the invention to provide such an elastic rail bearing which can be manufactured with low material costs.

SUMMARY OF THE INVENTION

Certain of the foregoing and related objects are readily attained with an elastic rail bearing for railroad rails having a top plate, a bottom plate, and a rubber plate disposed inbetween the top and bottom plates. The plates each have at least one hole formed therethrough with the hole of one plate being in registered alignment with the holes of the other plates thereby forming at least one aligned set of holes. The rubber plate and at least one of the top and bottom plates are configured such that one has at least one protrusion and the other has at least one corresponding recess for receiving the protrusion. The top and bottom plates each have an upstanding flange at the lateral ends thereof with the flange of the top plate spaced apart from, extending parallel to, and partially overlapping the corresponding flange of the bottom plate. Fastening means cooperating with and passing through the aligned set of holes in the top, bottom and rubber plates are provided for establishing an adjustable and variable initial stress in the rail. The fastening means preferably includes a bolt surrounded by a rubber ring, and a nut threadably engaged onto the bolt. Alternatively, a multiplicity of bolts each surrounded by a rubber ring and threadably engaged to a nut may be provided. A connecting rubber strip is disposed inbetween the flanges. With this design, the bearing can be readily and efficiently adjusted to different load or stress conditions.

Preferably, the rubber plate has a plurality of bores, a shore hardness A of 50 to 65, and covers substantially the total surface of the top and bottom plates. In a preferred embodiment of the invention, the rubber strip has a parallelogram shaped cross-section and has L-shaped metal strips attached on its edges by vulcanizing. The rubber strip may extend continuously around the bearing inbetween the flanges, or it may be divided intô spaced apart segments.

The rubber plate, due to its protrusions embedding in recesses in the top plate and/or bottom plate, can be varied in any desired way with respect to its wall thickness. In this way, loads can be absorbed as required. Furthermore, by this arrangement, even transverse or shearing forces may be effectively absorbed. Such transverse forces, however, are also absorbed by the strip of rubber disposed in the zone between the flanges of the top and bottom plates. Depending on the requirements, more of the transverse force can be absorbed by the rubber strip inbetween the flanges. These different possibilities for variation may be exploited in particular when a defined construction or design height is required and also where tilting motions that may occur have to be kept within narrow limits.

The quality of the rubber plate or layer disposed between the top and bottom plates may be adapted to the quality of the rubber strip or layer connecting the flanges or edges of the top and bottom plates. As a rule, the same Shore hardness is selected for these two rubber components. Also, the fact that the prestress produced by the bolts should cause degrees of deformation in the two rubber bodies that are as equal as possible, must be accounted for.

The rubber plate disposed between the top and bottom plates may be provided with any desired type of bores or holes for providing the capability of deformation and the desired elastic property. Generally, the bores are provided in the form of vertical channels that may be disposed more or less adjacent to each other. Significantly, the shape of the bores may be adapted to their arrangement. Furthermore, an important aspect is that the shape of the bores and their arrangement with respect to each other provide the most uniform stress distribution in the rubber plate when it is deformed.

The rubber plate disposed between the top and bottom plates preferably has a Shore hardness A of from about 50 to 65. The hardness is selected depending upon which stresses are expected and which other requirements the bearing is expected to satisfy. Since the rubber plate can be easily replaced or exchanged, it can be readily adapted to different requirements.

It is also possible, according to the invention, to arrange the rubber plate between the top and bottom plates in such a way that it covers the total surface of the top and bottom plates and such that it has bores only in the zones of the bolt and nut fastening, i.e. the only holes or bores in the rubber being the clearance holes for the bolts. In this way, the top and bottom plates can be largely relieved of bending stresses. Furthermore, with this design, the metal top and bottom plates may be made of deep-drawn sheet steel parts, which as a rule are less expensive than molded metal plates. Also, easy adjustment to the particular requirements is possible due to the exchangeability of the plates.

Another important feature of the invention is that the strip or layer of rubber disposed between the parallel vertical partially overlapping flanges or edges of the top and bottom plates has supporting strips attached thereto by vulcanizing. In the simple case, simple rubber profiles or sections may be inserted between the flanges if the partially overlapping flange surfaces include grooves shaped to match these sections. However, for absorbing transverse or shearing forces, it is much more advantageous to provide the rubber strips with metal reinforcing strips, which are attached to the rubber layer by vulcanizing. These metal strips provide a secure attachment to the top and bottom plates while simultaneously permitting easy exchangeability. Due to the L-shaped design of the metal reinforcing strips, installation is possible in a simple and reliable manner. Since the rubber strip or layer between the metal strips is preferably provided as a section in the shape of a parallelogram, it attains (via shear loading) a special progressive property of elasticity. Furthermore, the shape of a parallelogram permits a relatively high degree of elastic deflection without any damage resulting from the high degree of elastic excursion. In addition, the strip of rubber has the advantage of protecting the interior of the bearing against dirt. An aperture is useful if the rubber strips extend continuously and thereby form a closed hollow space between the top and bottom plates. Preferably, the aperture is disposed in the bottom plate. Such an aperture will prevent the compression of air and thus prevent the generation of heat within the bearing. Furthermore, it prevents the accumulation of moisture in the interior of the rail bearing.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE DRAWINGS

In the drawings, wherein similar reference characters denote similar elements throughout the several views.

Figure 1:
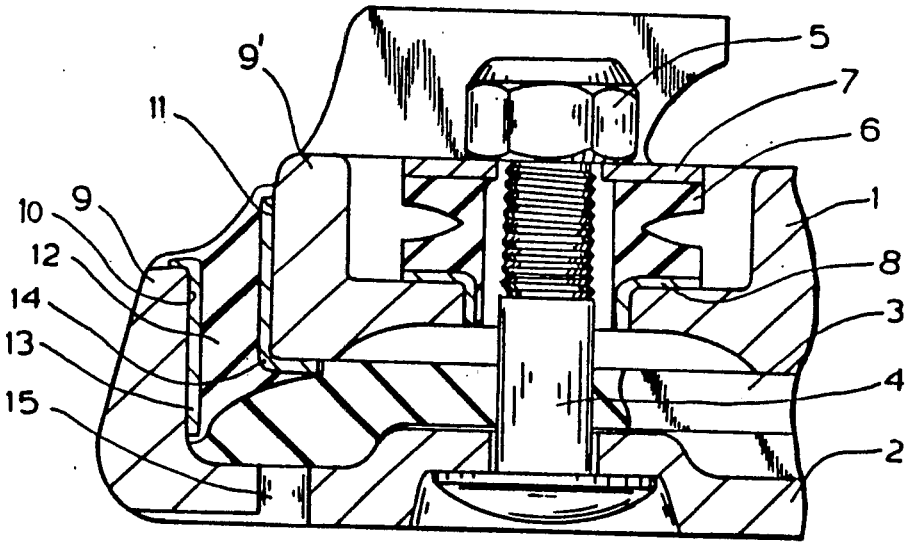
FIG. 1 is a fragmentarily-illustrated transverse sectional view of a novel elastic rail bearing, embodying the present invention.

Turning now in detail to the appended drawings, therein illustrated is a novel elastic rail bearing embodying the present invention which, as shown in FIG. 1, is comprised of a top plate 1, a bottom plate 2, and a rubber plate 3 disposed between plates 1 and 2. Top plate 1 and bottom plate 2 are connected to each other by means of a bolt 4 having a nut 5. Furthermore, bolt 4 is encircled by an annular rubber ring 6 having ring attachments 7 and 8 at its top and bottom surfaces. Rubber plate 3 is compressed by turning nut 5 causing it to advance on bolt 4. Such tightening, in connection with rubber ring 6, causes top plate 1 to be in a state of elastic suspension with respect to bottom plate 2. Such prestressing effects a defined natural frequency state in the bearing which may be adjusted to the requirements of the application.

At their lateral, edges, top plate 1 and bottom plate 2 have upstanding flanges 9' and 9', respectively. Flanges 9 and 9' have vertically extending surfaces 10 and 11, respectively, which extend parallel to each other, and parallel to the direction of elastic deflection. A rubber strip 12 is disposed between surfaces 10 and 11. On its sides, rubber strip 12 has metal strips 13 and 14 attached thereto by vulcanization. Rubber strip 12 with metal strips 13 and 14 may be readily inserted into the space intended for it between the flanges and serves for absorbing transverse forces as they may occur, for example, in curves of the railroad or within the zones of switch points. The vulcanized assembly of rubber strip 12 and metal strips 13 and 14 is held in place between flanges 9 and 9' by elastic forces. Bottom plate 2 has an aperture or vent 15.

Figure 2:
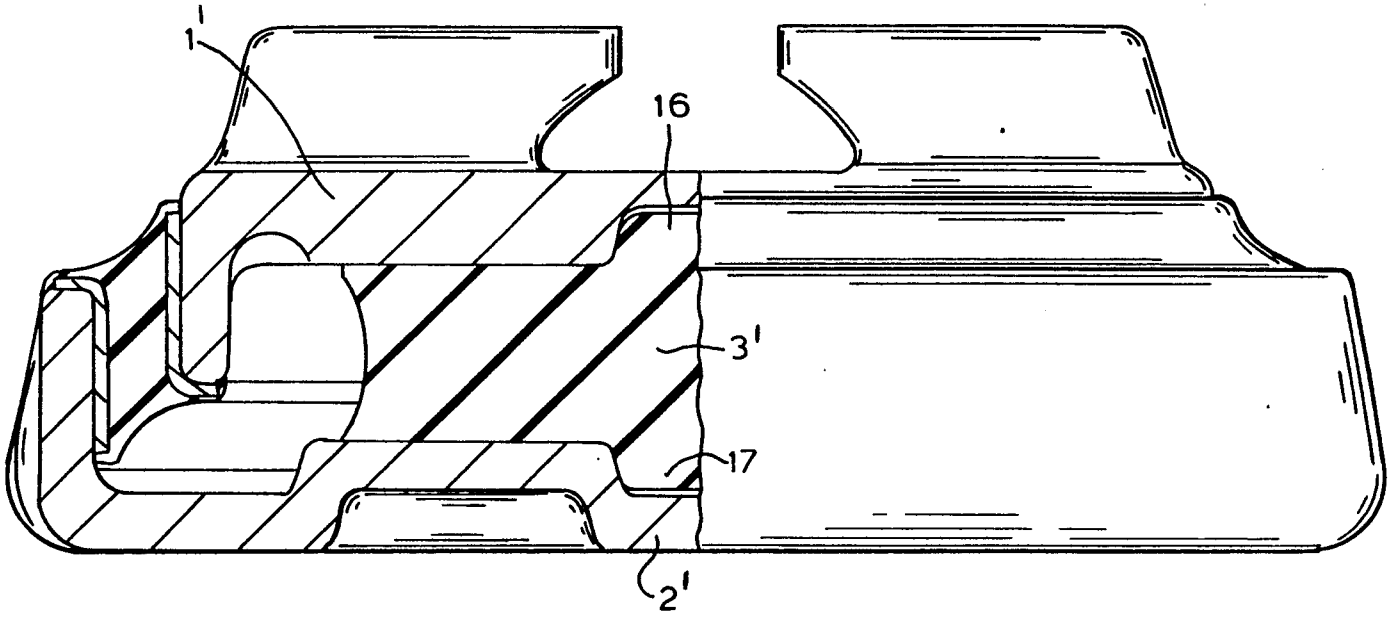
FIG. 2 is a fragmentarily-illustrated transverse sectional view of a second embodiment of the invention.
Figure 3:
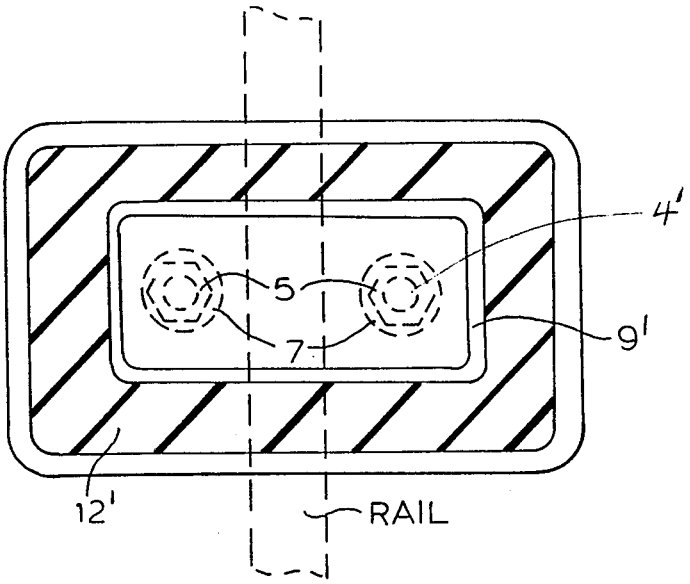
FIG. 3 is a schematically-illustrated section view of a third embodiment of the invention.
Figure 4:
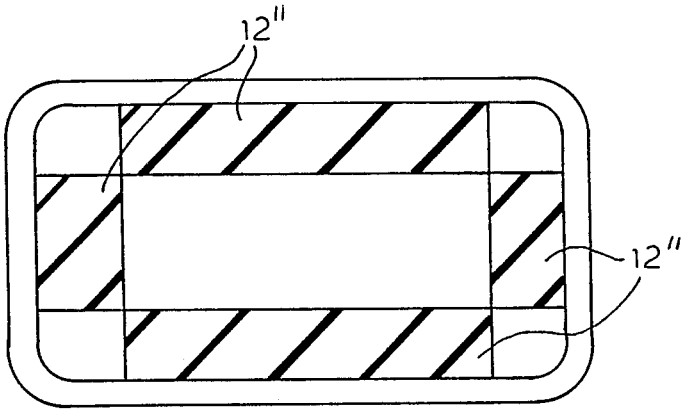
FIG. 4 is a schematically-illustrated section view of yet a fourth embodiment of the invention.

In a second embodiment of the invention as shown in FIG. 2, rubber plate 3' has elevations or protrusions 16 and 17, which matchingly engage clearances or recesses provided in top plate 1' and bottom plate 2'. In this embodiment, rubber plate 3 is suitable for absorbing transverse forces as well. As shown in FIGS. 3 and 4, respectively, rubber strip 12' and 12" may extend continuously around the bearing in between the flanges of the top and bottom plates, or it may be divided into segments therein. In addition, FIG. 3 illustrates (in phantom) the use of two bolts 4', and the position of the rail on the bearing.

Figure 5:
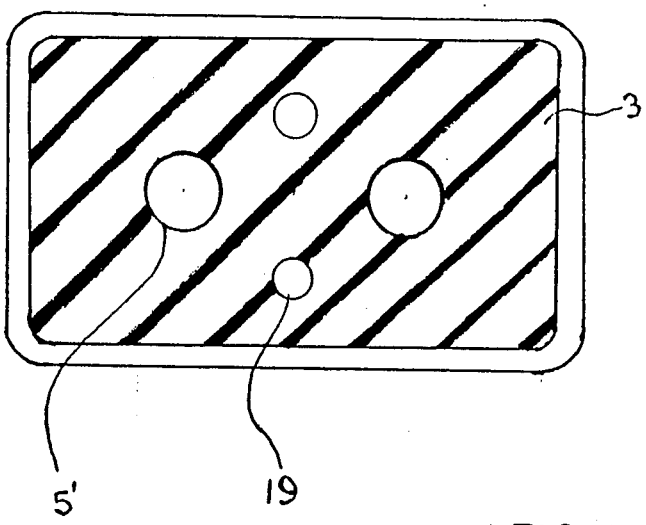
FIG. 5. is a top view of the rubber plate shown in FIG. 1.

Referring to FIG. 5, there is shown a top view of rubber plate 3 including through bores 5' for receiving bolts 4. Also included are bores or holes 19 for providing the capability of deformation and the desired elastic property. The bores 19 are spaced to provide a uniform stress distribution.

Thus, while only several embodiments of the present invention have been shown and described, it is obvious that many changes and modifications may be made thereunto, without departing from the spirit and scope of the invention.

What is claimed is:

1. An elastic rail bearing for railroad rails comprising:

a top plate, a bottom plate, and a rubber plate disposed inbetween said top and bottom plates, said plates each having at least one hole formed therethrough with the holes being in registered alignment with each other forming at least one aligned set of holes, said rubber plate and at least one of said top and bottom plates being configured such that one has at least one protrusion and the other has at least one corresponding recess for receiving said protrusion, said top and bottom plates each having an upstanding flange at the lateral ends thereof with the flange of said top plate being spaced apart from, extending parallel to, and partially overlapping the corresponding flange of said bottom plate;

fastening means cooperating with and passing through said aligned set of holes in said top, bottom and rubber plates for establishing an adjustable and variable initial stress in said rail bearing;

a variable presetressing means disposed between said fastening means and said top plate said adjustable and variable initial stress; and a connecting rubber strip disposed inbetween said flanges.

2. The elastic bearing as defined in claim 1, wherein said fastening means comprises a bolt surrounded by a rubber ring, and a nut threadably engaged onto said bolt.

3. The elastic bearing as defined in claim 2, wherein said fastening means comprises a multiplicity of bolts, each of which is surrounded by a rubber ring, and a multiplicity of nuts each of which is threadably engaged onto one of said bolts.

4. The elastic bearing as defined in claim 1, wherein said rubber plate has a plurality of bores therethrough for providing a pre-specified elastic property.

5. The elastic bearing as defined in claim 1, wherein said rubber plate has a Shore hardness A of approximately 50 to 65.

6. The elastic bearing as defined in claim 5, wherein said rubber strip has a parallelogram-shaped cross section.

7. The elastic bearing as defined in claim 1, wherein said rubber plate substantially covers the two opposing surfaces of said top and bottom plates.

8. The elastic bearing as defined in claim 1, wherein said rubber strip disposed between said flanges has metal supporting strips attached to it by vulcanizing.

9. The elastic bearing as defined in claim 8, wherein said metal supporting strips have an L-shaped cross section and are supported on said flanges of said top and bottom plates.

10. The elastic bearing as defined in claim 1, wherein said bottom plate has an aperture which serves as a vent.

11. The elastic bearing as defined in claim 1, wherein said rubber strip extends continuously around said bearing inbetween said flanges of said top and bottom plates.

12. The elastic bearing as defined in claim 1, wherein said rubber strip is divided into spaced apart segments disposed inbetween said flanges of said top and bottom plates.

13. An elastic rail bearing as set forth in claim 1, wherein said variable prestressing means disposed between said fastening means and said top plate is an annular rubber ring, whereby tightening of said fastening means causes compression of said annular ring putting said top plate in the state of elastic suspension with respect to said bottom plate.

* * * * *